US009987858B2

(12) United States Patent
Perez Gellida et al.

(10) Patent No.: US 9,987,858 B2
(45) **Date of Patent: *Jun. 5, 2018**

(54) PRINT ZONE HEATING

(71) Applicant: HEWLETT-PACKARD DEVELOPMENT COMPANY, L.P., Houston, TX (US)

(72) Inventors: Francisco Javier Perez Gellida, Barcelona (ES); Ezequiel Jordi Rufes Bernad, Sant Cugat del Valles (ES); Marina Cantero Lazaro, Barcelona (ES); Antonio Gracia Verdugo, Barcelona (ES); Santiago Sanz Ananos, Sant Cugat del Valles (ES); Roger Bastardas Pulgoriol, Sant Just Desvern (ES); Mikel Zuza Irurueta, Barcelona (ES); Juan Manuel Valero Navazo, Sant Cugat del Valles (ES); Emilio Angulo Navarro, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/121,507

(22) PCT Filed: Feb. 26, 2014

(86) PCT No.: PCT/US2014/018689

§ 371 (c)(1),
(2) Date: Aug. 25, 2016

(87) PCT Pub. No.: WO2015/130275

PCT Pub. Date: Sep. 3, 2015

(65) Prior Publication Data

US 2016/0368279 A1 Dec. 22, 2016

(51) Int. Cl.
*B41J 11/00* (2006.01)
*B41J 29/377* (2006.01)
(Continued)

(52) U.S. Cl.
CPC ..... *B41J 11/002* (2013.01); *B41J 2/01* (2013.01); *B41J 29/377* (2013.01); *H05B 3/00* (2013.01); *H05B 2203/035* (2013.01)

(58) Field of Classification Search
CPC ..... B41J 11/002; B41J 2/01; B41J 29/377; H05B 2203/035; H05B 3/00
(Continued)

(56) References Cited

U.S. PATENT DOCUMENTS 4,502,056 A 2/1985 Matsuda
4,675,695 A 6/1987 Samuel et al.
(Continued)

FOREIGN PATENT DOCUMENTS

JP S58114976 7/1983
JP H06314046 11/1994
(Continued)

OTHER PUBLICATIONS

Cochior, C. et al.; Cold Start Control of Industrial Printers ; http://ieeexplore.ieee.org/xpl/articleDetails.jsp?tp=&arnumber=6265982&queryText%3Dprinter+temperature+control ; Jul. 11, 2012.

(Continued)

*Primary Examiner* — Jannelle M Lebron
(74) *Attorney, Agent, or Firm* — HP Inc. Patent Department

(57) ABSTRACT

In one example, a print zone heater includes a structure defining a plenum, a heating element, a fan to move air over
(Continued)

the heating element into the plenum, and a conduit from the plenum to carry heated air into the print zone.

16 Claims, 11 Drawing Sheets

(51) Int. Cl.
*B41J 2/01* (2006.01)
*H05B 3/00* (2006.01)

(58) Field of Classification Search
USPC ..... 347/101, 102
See application file for complete search history.

(56) References Cited

U.S. PATENT DOCUMENTS

| | | | |
|---|---|---|---|
| 5,089,830 | A | 2/1992 | Cha et al. |
| 5,737,674 | A | 4/1998 | Venkatesan et al. |
| 5,920,331 | A | 7/1999 | Silverbrook |
| 6,390,618 | B1 | 5/2002 | Wotton et al. |
| 6,554,514 | B2 | 4/2003 | Wotton et al. |
| 6,771,916 | B2 | 8/2004 | Hoffman et al. |
| 8,275,278 | B2 | 9/2012 | Ishigaya et al. |
| 8,351,815 | B2 | 1/2013 | Eden et al. |
| 2009/0027472 | A1 | 1/2009 | Sekiya |
| 2010/0282910 | A1 | 11/2010 | Stothers et al. |
| 2011/0036255 | A1 | 2/2011 | Monclus et al. |
| 2011/0267410 | A1* | 11/2011 | Yamamoto ..... B41J 11/002 347/102 |
| 2013/0215203 | A1* | 8/2013 | Chen ..... B41J 11/002 347/102 |

FOREIGN PATENT DOCUMENTS

| | | |
|---|---|---|
| JP | H1120144 | 1/1999 |
| JP | 2007121354 | 5/2007 |
| JP | 2009214416 | 3/2008 |
| JP | 2009234103 | 3/2008 |
| JP | 2013149006 | 8/2013 |
| WO | WO2015/130275 | 9/2015 |
| WO | WO2015/130325 | 9/2015 |
| WO | WO2015/130326 | 9/2015 |

OTHER PUBLICATIONS

Crouch, K.G. et al.;The Control of Press Cleaning Solvent Vapors in a Small Lithographic Printing Establishment: http://www.tandfonline.com/doi/abs/10.1080/104732299302918#.
UnOOF7UcyYQ > on pp. 329-338; Nov. 30, 2010.
Yoneya, A., et al.; Rapid Zero-crose Switch Control of AC Resistive Load with Deep Delta-sigma Modulator; http://ieeexplore.ieee.org/xpl/articleDetails.jsp?tp=&arnumber=6119395
&queryText%3Dprevent+flicker+zero+cross+power+share >; Nov. 7-10, 2011.

* cited by examiner

PRINT ZONE HEATING

BACKGROUND

Inkjet printers use printheads with tiny nozzles to dispense ink or other printing fluid on to paper or other print substrates. The temperature of the environment in which an inkjet printer is used can affect the quality of the printed image.

DRAWINGS

The same part numbers designate the same or similar parts throughout the figures.

DESCRIPTION

It is desirable that inkjet printer have the capability to print high quality images in cooler operating environments. Lower ambient temperatures, however, can adversely affect print quality, particularly for large format printers dispensing water based inks. (Water based inks are commonly referred to as "latex" inks.) A new print zone heater has been developed to raise the temperature of the print zone to help maintain good print quality in cooler operating environments. In one example, the print zone heater includes a heater, a fan to move air heated by the heater, a plenum to receive heated air from the heater at the urging of the fan, and a conduit though which heated air may pass from the plenum to the print zone. In one specific implementation for a scanning type inkjet printer, the structure defining the plenum is configured to simultaneously support the printhead carriage and distribute heated air across the print zone. These and other examples of the new print zone heater may be incorporated into an air heating system that also includes a dryer and a vapor control heater downstream from the dryer to help reduce the formation of fog as moisture laden air from the dryer reaches the cooler ambient air surrounding the printer.

Examples shown in the figures and described herein illustrate but, do not limit the disclosure, which is defined in the Claims following this Description.

As used in this document: a "printhead" means that part of an inkjet printer or other inkjet type dispenser that dispenses fluid, for example as drops or streams; and "printing fluid" means fluid that may be dispensed with a printhead. A "printhead" is not limited to printing with ink but also includes inkjet type dispensing of other fluid and/or for uses other than printing.

Figure 1:
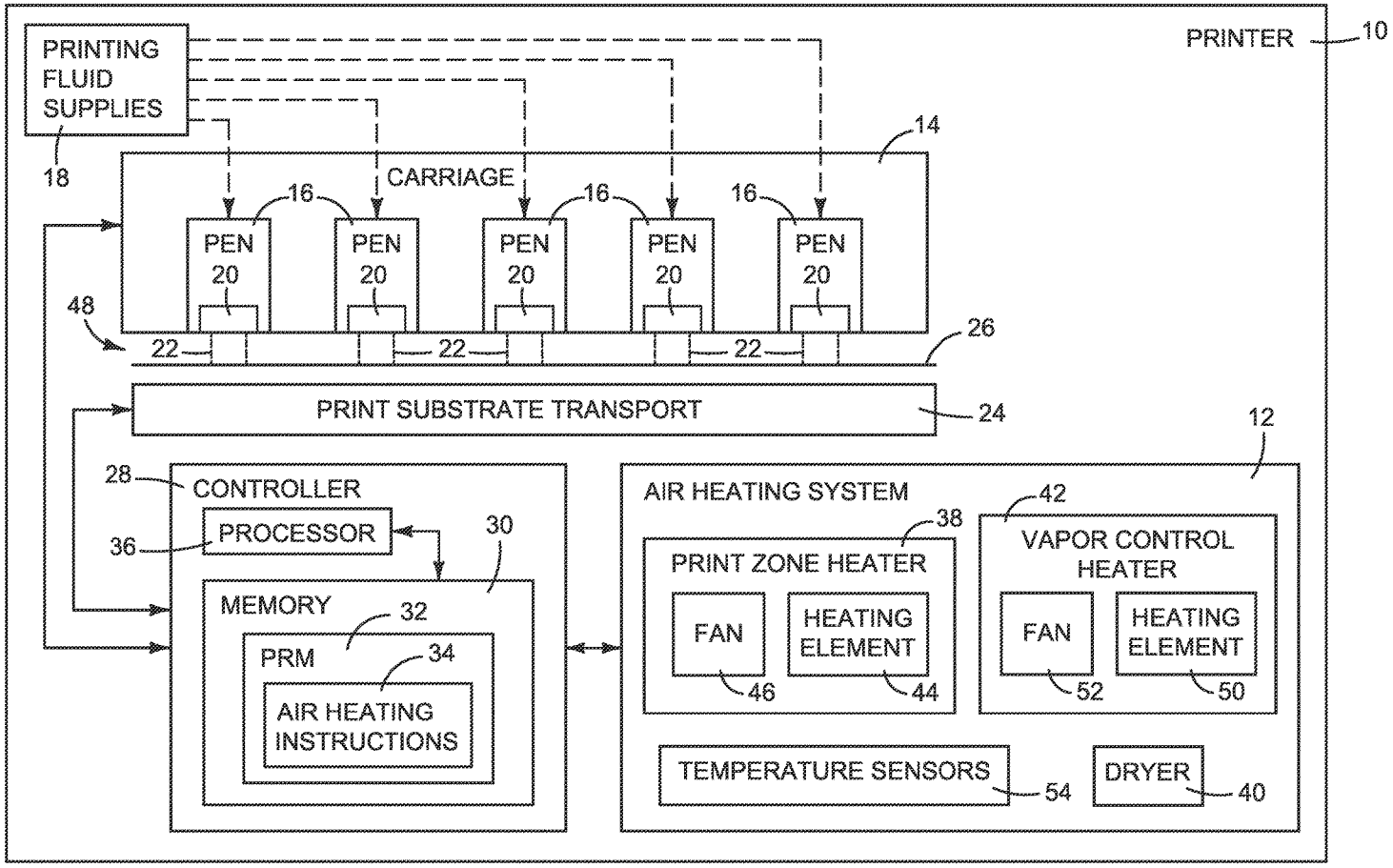
FIG. 1 is a block diagram illustrating an inkjet printer implementing one example of a new air heating system that includes a print zone heater and a vapor control heater.

FIG. 1 is a block diagram illustrating an inkjet printer 10 implementing one example of an air heating system 12. Referring to FIG. 1, printer 10 also includes a carriage 14 carrying multiple ink pens 16 connected to printing fluid supplies 18. Inkjet ink pens 16 are also commonly referred to as ink cartridges or print cartridges and may dispense ink and other printing fluids from a printhead or multiple printheads 20 contained within each pen 16, for example as drops or streams 22. A transport mechanism 24 advances a paper or other print substrate 26 past carriage 14 and ink pens 16. A controller 28 is operatively connected to heating system 12, carriage 14, printheads 20 and substrate transport 24. Controller 28 represents the programming, processors and associated memory, and the electronic circuitry and components needed to control the operative elements of printer 10. In particular, controller 28 includes a memory 30 having a processor readable medium (PRM) 32 with instructions 34 for controlling the functions of heating system 12 and a processor 36 to read and execute instructions 34.

A scanning carriage 14 with pens 16 illustrates just one example of a printhead assembly that may be used with air heating system 12. Other types of printhead assemblies are possible. For example, instead of ink pens 16 with integrated printheads 20 shown in FIG. 1, the printhead(s) could be mounted separately on carriage 14 with replaceable ink containers operatively connected to the carriage mounted printhead(s). Although remote printing fluid supplies 18 are shown, the printing fluids could be located on carriage 14 or contained within each pen 16. Also, instead of a scanning carriage 14, printhead(s) spanning a full width of print substrate 26 that remain stationary during printing could also be used.

In this example, air heating system 12 includes a print zone heater 38, a dryer 40, and a vapor control heater 42. Print zone heater 38 includes a heating element 44 and a fan 46 to move heated air into a print zone 48 where ink or other printing fluid is (or will be) dispensed from printheads 20 on to substrate 26. Vapor control heater 42 includes a heating element 50 and a fan 52 to move heated air into the stream of air leaving the printer downstream from dryer 40. Heating system 12 may also include temperature sensors 54 associated with heaters 38 and 42 and operatively connected to controller 28 to help control the heating functions of each heater. Each temperature sensor 54 may be implemented in a thermostat or other temperature control device as part of system 12 or as a discrete part otherwise connected to controller 28.

Figure 2:
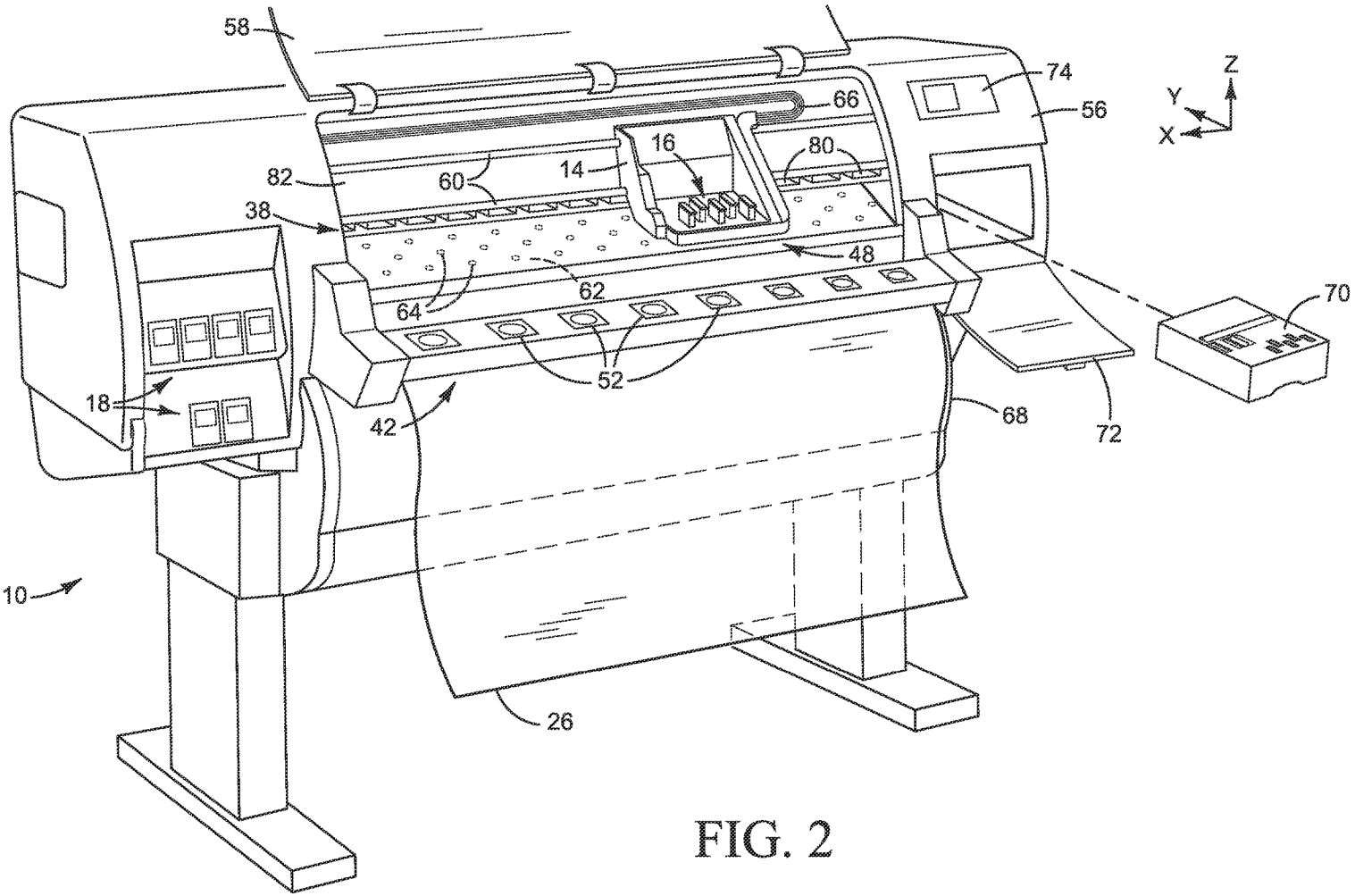
FIG. 2 illustrates a large format inkjet printer implementing one example of an air heating system.

FIG. 2 illustrates a large format inkjet printer 10 implementing one example of an air heating system 12. Referring to FIG. 2, carriage 14 carrying pens 16 is enclosed in a printer housing 56. Carriage 14 and print zone 48 may be accessed through a door 58 in housing 56. Door 58 is open in FIG. 2 to show carriage 14 and print zone 48. Carriage 14 slides along rails 60 over a platen 62. Platen 62 supports a print substrate web 26 as it passes under carriage 14 for printing with pens 16. In the example shown, platen 62 includes vacuum holes 64 connected to a vacuum system (not shown) to help hold substrate 26 flat in print zone 48. Printer 10 also includes ink supply containers 18 supported in housing 56 and connected to pens 16 through flexible tubing 66. A supply roll (not shown) of web substrate 26 is supported in a lower part 68 of housing 56. Printer 10 may also include a service module 70 at one end of platen 62 accessed through a service door 72 and a local display and control panel 74.

Figure 3:
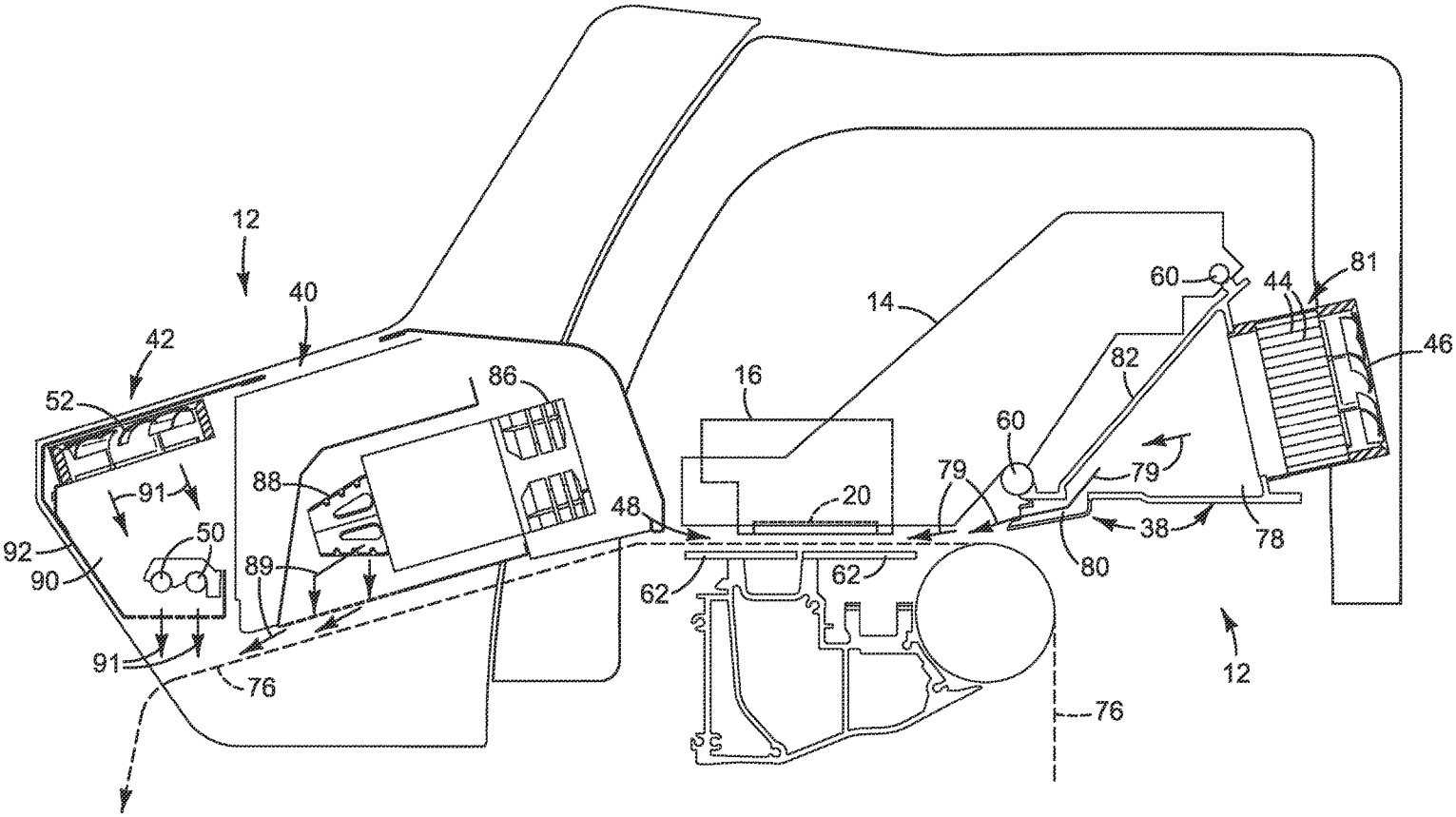
FIG. 3 is a side elevation view showing the air heating system in the printer shown in FIG. 2.
Figure 4:
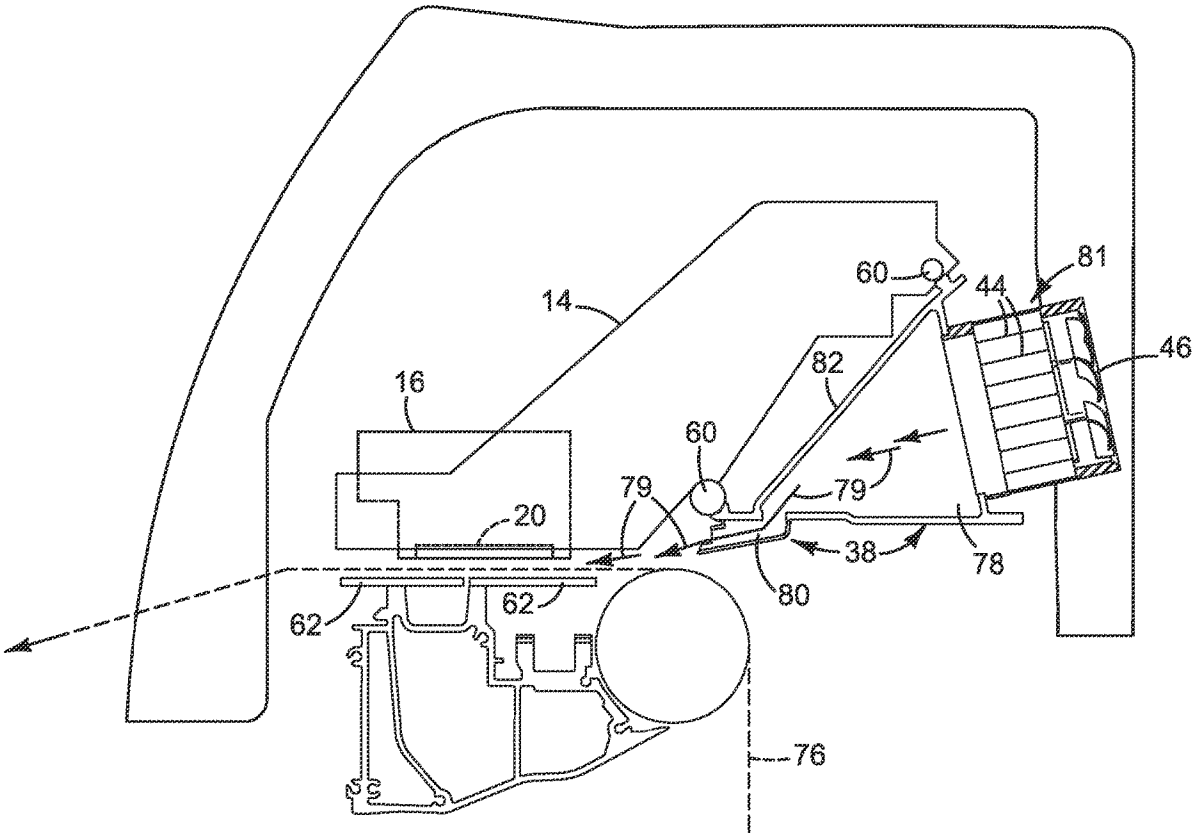
FIG. 4 is a side elevation view of the print zone heater in the air heating system in the printer shown in FIGS. 2 and 3.
Figure 5:
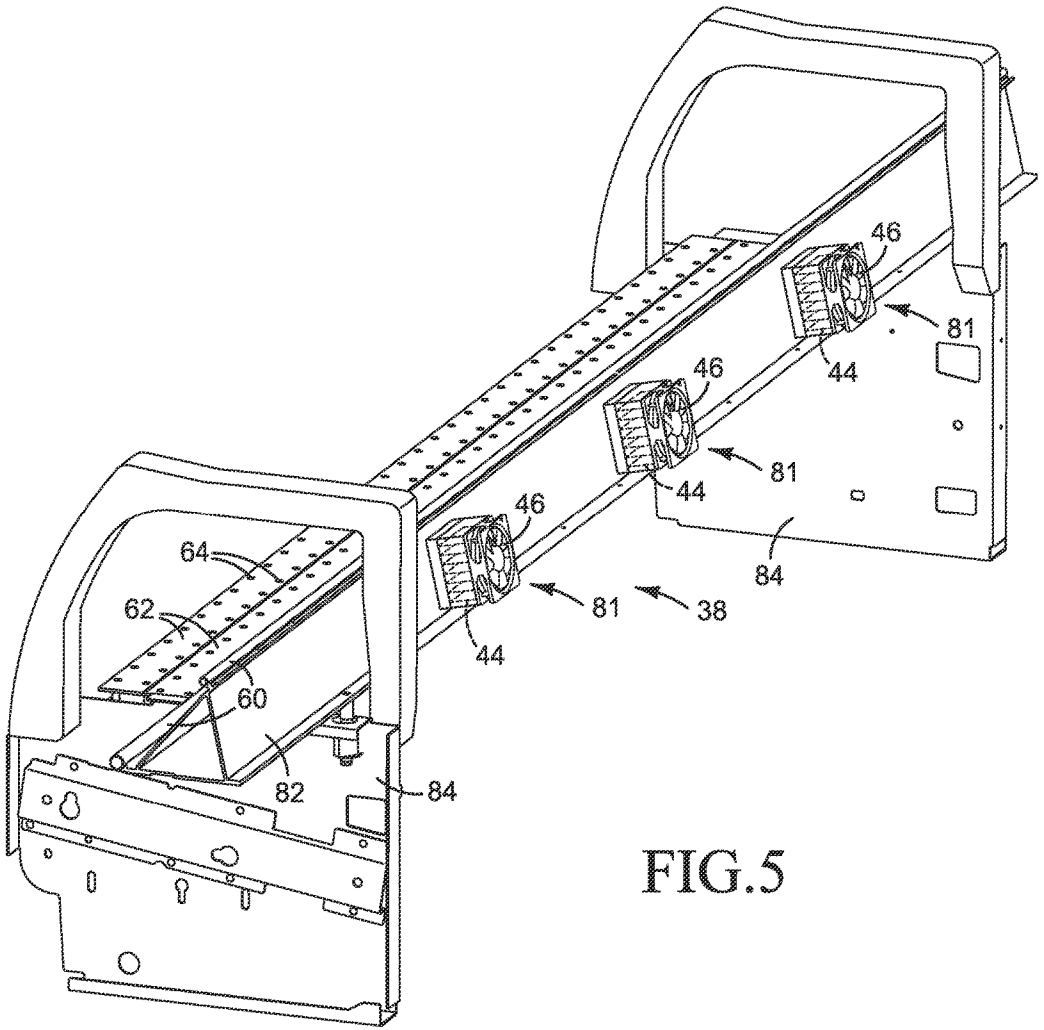
FIGS. 5-7 illustrate the print zone heater of FIG. 4 in more detail.
Figure 6:
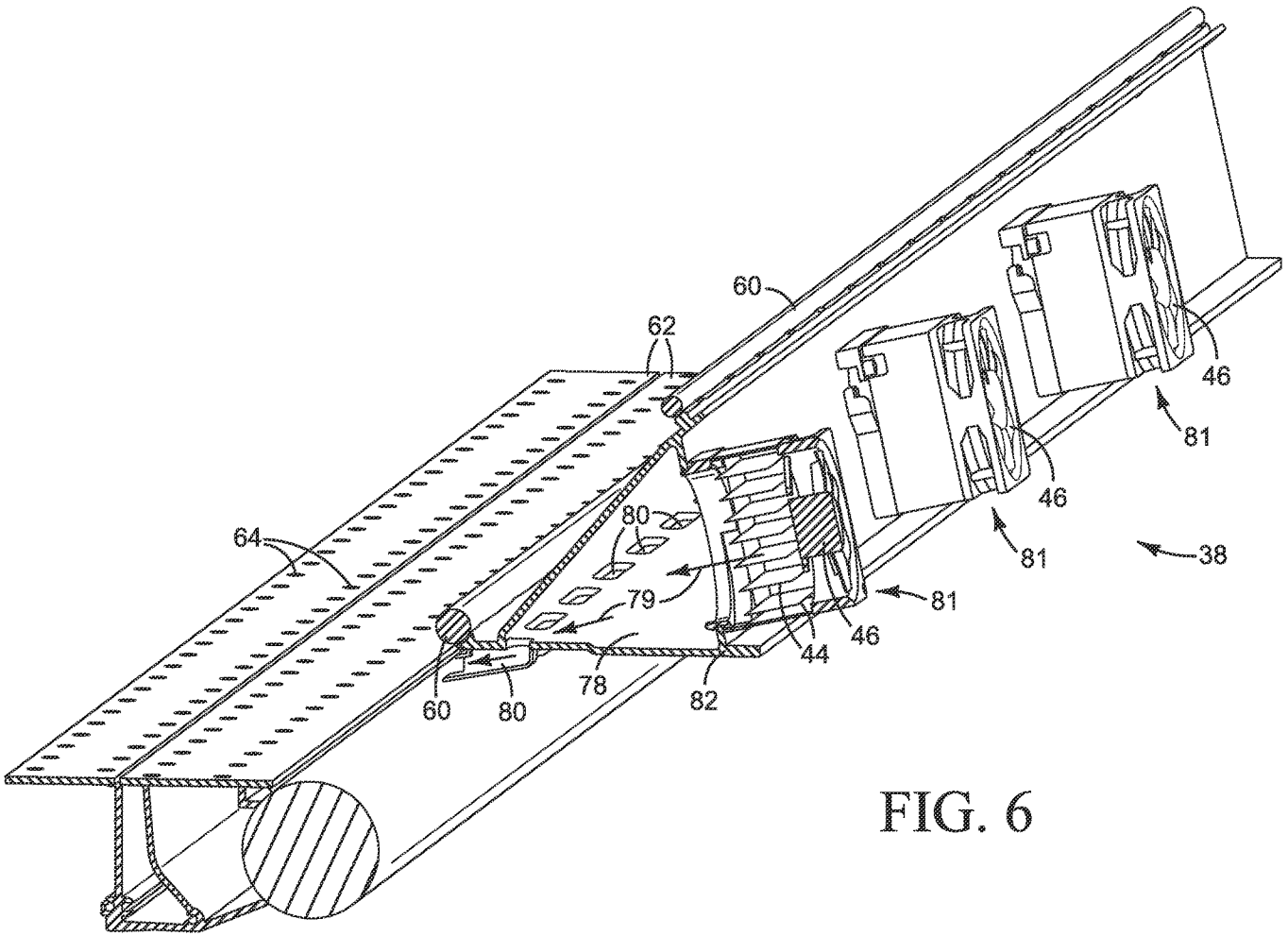
Figure 7:
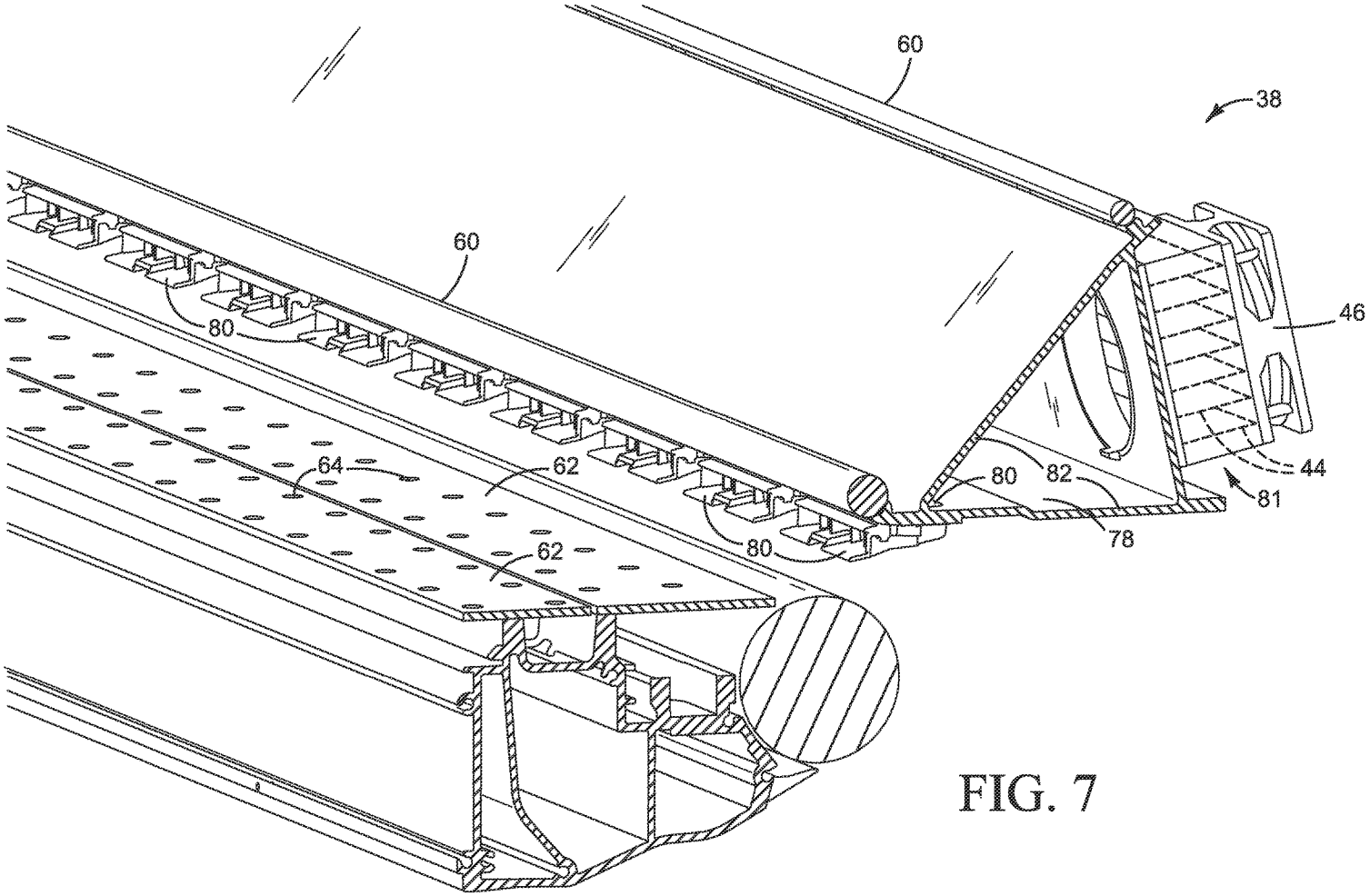

FIG. 3 is a side elevation view showing air heater system 12 from printer 10 in FIG. 2. FIGS. 4-7 show print zone heater 38 in system 12 in more detail. Referring to FIGS. 3-7, print zone heater 38 is positioned upstream from printheads 20 along the path 76 print substrate 26 moves through printer 10. In this example, heater 38 includes a plenum 78 and conduits 80 to carry heated air from plenum 78 to print zone 48. Conduits 80 are oriented to direct heated air on to and along print substrate 26 in the direction substrate 26 moves through print zone 48 during printing. Also, in this example, a discrete heating element 44 is integrated into a heating module 81 with each fan 46 and the fans 46 are positioned upstream from the heating elements 44 in the direction of air flow 79 through heater 38 to print zone 48. Thus, each fan 46 blows air over a corresponding heating element 44 into plenum 78 for distribution across the full width of print zone 48 through conduits 80.

Other suitable print zone air heating configurations are possible. For example, more or fewer fans 46 and conduits 80 could be used. However, the rate of air flow into the print zone should be low enough to avoid adversely affecting the placement of printing fluid on the print substrate. While it is expected that heaters associated with each fan, such as those shown in FIGS. 3-7, will be more efficient in this comparatively low flow application, a single heating element or a single group of heating elements common to all of the fans could be used and/or the fans could be positioned downstream from the heating element(s) to draw air through the heating element(s) into the plenum. For another example, heated air could be ducted directly to the print zone without a plenum. Nevertheless, it is expected that a plenum usually will be desirable to help efficiently distribute heated air to the print zone. Also, plenum 78 shown in the figures is defined by a triangular structure 82 affixed to a printer chassis 84 (FIG. 5) to support carriage rails 60. Structure 82 is sometimes referred to as a "scan beam" because it functions as a structural support beam for printhead carriage 14 as it is scanned back and forth on rails 60 across print zone 48 during printing. Thus, in the example shown, scan beam 82 functions both as a plenum 78 in print zone heater 38 and a support for carriage 14.

Print quality problems associated with cooler ambient temperatures usually are worse at the beginning of a print job when the temperature in the print zone is lower. As the printer works, the print zone warms and print quality improves. Print zone heater 38 may include a variable power heating element 44 to supply more heat when the print zone is cooler and less heat when the print zone is warmer. Alternatively, two (or more) discrete heating elements 44 could be used to vary the power output of heater 38. A temperature sensor 54 (FIG. 1) may be used to monitor the temperature of print zone 48 to help control heating element(s) 44 and fan(s) 46 in print zone heater 38.

Figure 8:
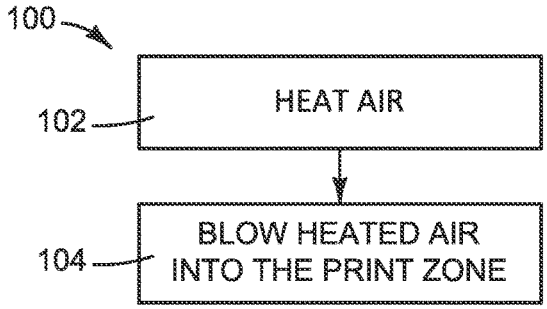
FIG. 8 is a flow diagram illustrating one example of a method for heating a print zone such as might be implemented with the print zone heater shown in FIGS. 3-7.
Figure 9:
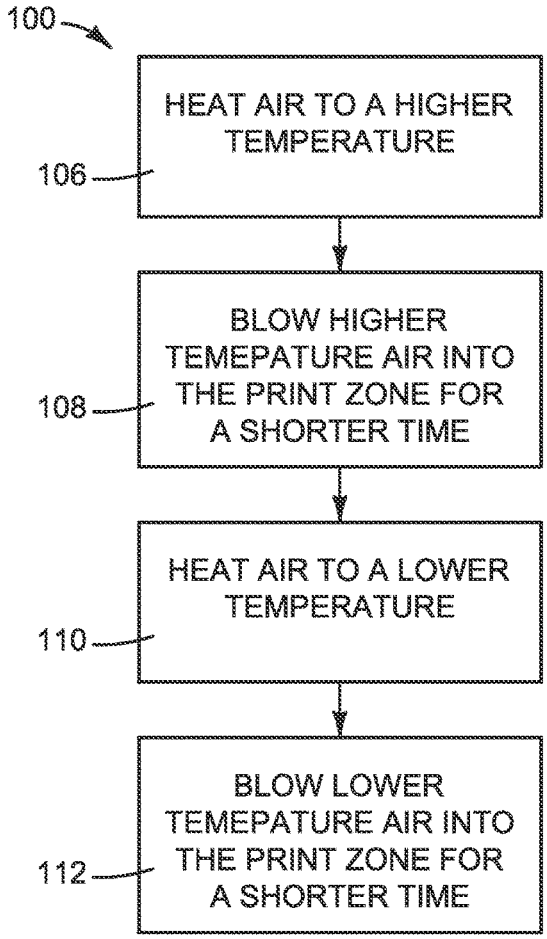
FIG. 9 is a flow diagram illustrating one example for implementing the air heating step in the method of FIG. 8.

FIG. 8 is a flow diagram illustrating one example of a method 100 for heating a print zone, such as might be implemented with print zone heater 38 shown in FIGS. 3-7. The method of FIG. 8 may be performed, for example, at the direction of controller 28 executing air heating instructions 34. Referring to FIG. 8, air is heated (step 102) and the heated air is blown into the print zone upstream from the printhead(s) in a direction downstream along the path the print substrate is moved through the printer, as indicated by air flow arrows 79 in FIGS. 3 and 4 (step 104). FIG. 9 is a flow diagram illustrating one specific implementation for method 100 shown in FIG. 8. Referring to FIG. 9, air is heated to a first temperature (step 106) and blown into the print zone for a first time (step 108). Then the air is heated to a second temperature lower than the first temperature (step 110) and blown into the print zone for a second time longer than the first time (step 112). For example, air is heated at the first, higher temperature and blown into the print zone for the first, shorter time to quickly warm the print zone at the beginning of a print job when the print zone is cool and then the air temperature is reduced to continue to maintain the print zone at the desired temperature during printing.

While the operating parameters of a print zone heater 38 may vary depending on the particular printer and printing environment as well as the number, size and configuration of the fan(s) and heating element(s), testing indicates that for an inkjet printer 10 with a print zone 48 up to about 2.64 m wide operating at a room temperature of about 15° C., a desired print zone temperature of about 30° C. may be reached and maintained by: (1) initially applying more power through one or multiple heating elements 44 to heat the air to a higher temperature, about 55° C. for example, to quickly warm the print zone to the desired temperature; and then (2) reducing the power through heating element 44 to heat the air to a lower temperature, about 40° C. for example, to maintain the desired print zone temperature during printing.

Referring again to FIG. 3, printer 10 also includes a dryer 40 positioned downstream from print zone 48 to dry ink and other printing fluids dispensed on to print substrate 26. In this example, dryer 40 includes a fan 86 and heating element 88 to blow hot air on to print substrate 26, as indicated by flow arrows 89. Dryer 40 usually will deliver much hotter air at much higher air flows compared to print zone heater 38, for example to quickly evaporate water from latex inks. The moisture in the hot air flowing out of printer 10 downstream from dryer 40 may condense into vapor that can produce a noticeable fog, particularly at high print volumes in cooler operating environments. Accordingly, a vapor control heater 42 may be added to introduce warm air into the moisture laden air leaving the printer to inhibit vapor condensing out of the air.

Figure 10:
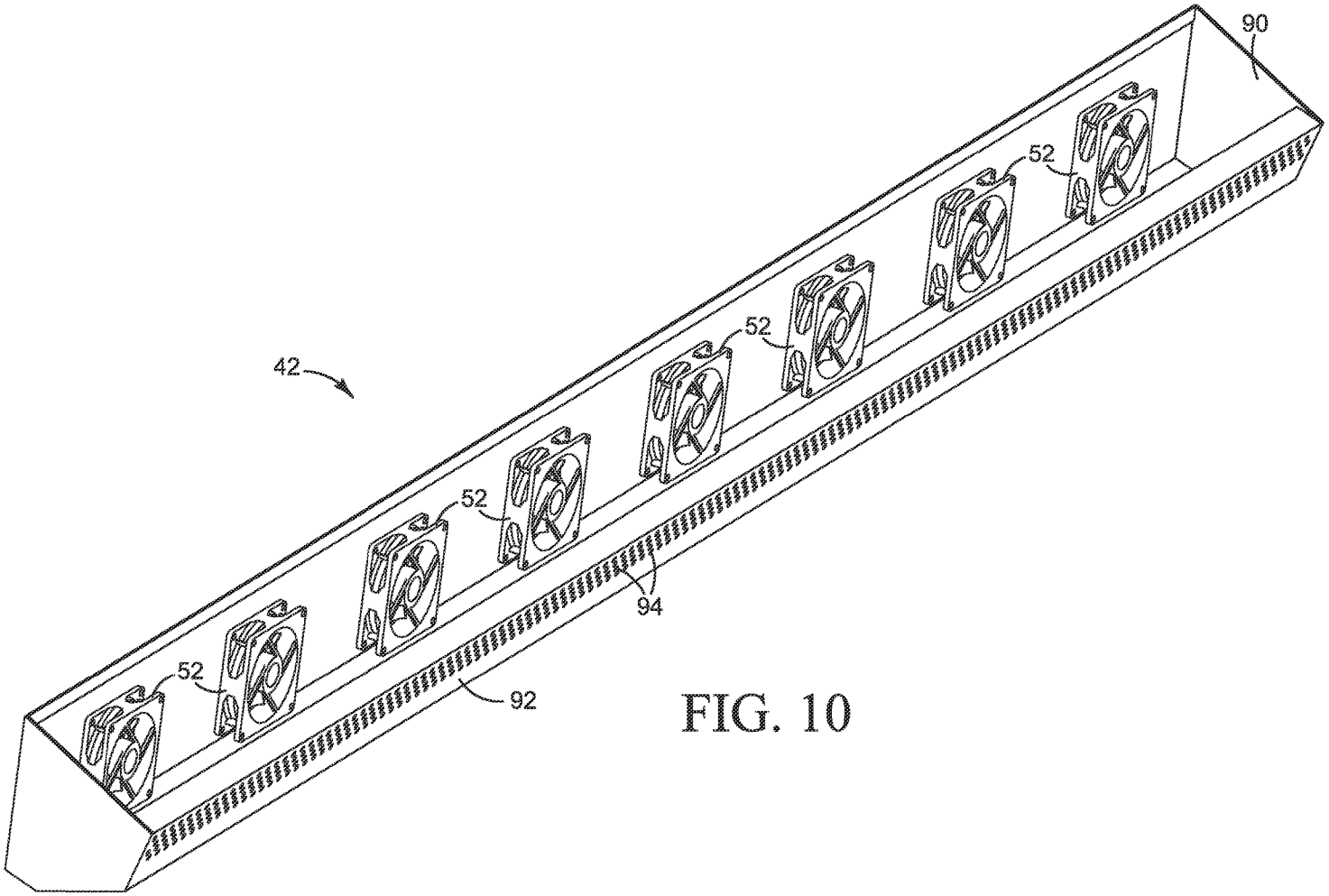
FIGS. 10 and 11 illustrate the vapor control heater in the air heating system shown in the printer shown in FIG. 3 in more detail.
Figure 11:
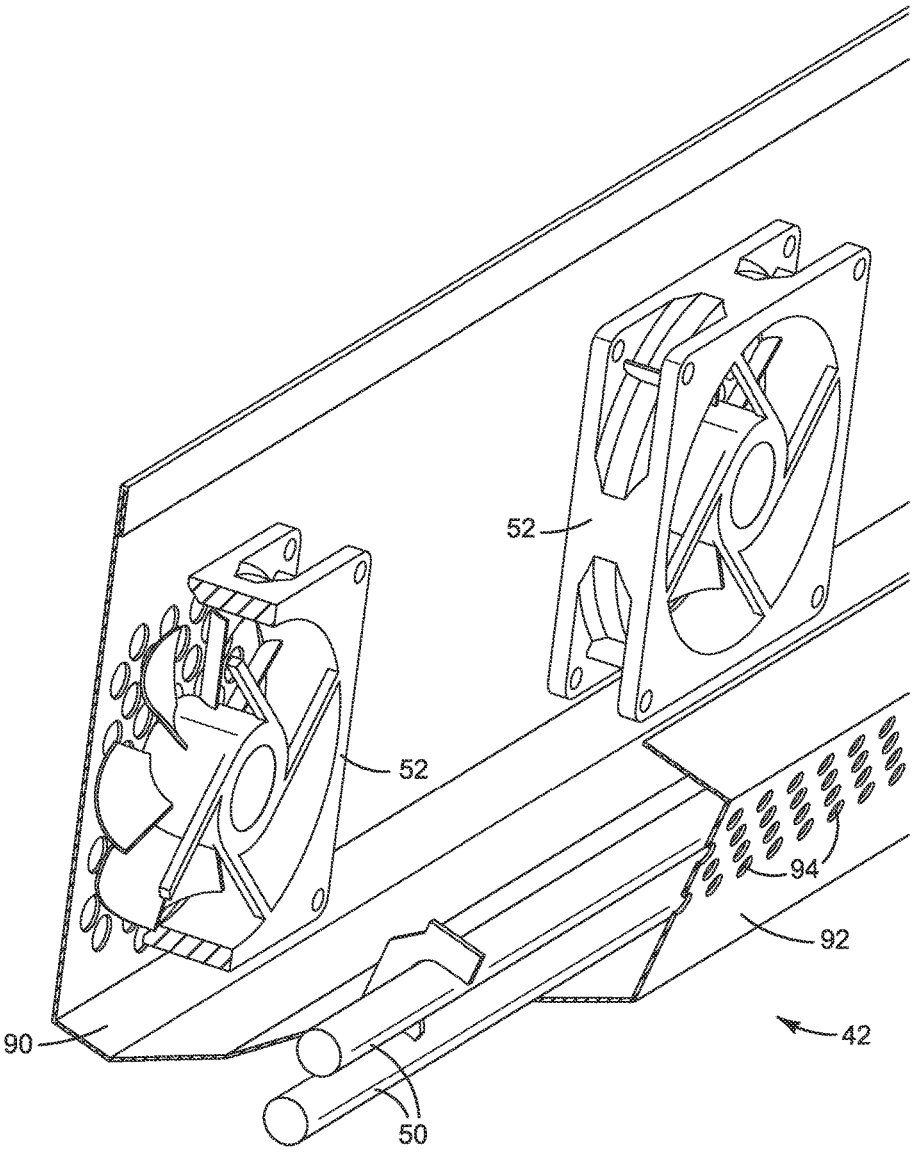

Referring now also to the detail views of FIGS. 10 and 11, vapor control heater 42 includes a group of fans 52 positioned across the width of print substrate 26 to draw ambient air into a plenum 90 and blow the air over heating elements 50 and out into the moisture rich air downstream from dryer 40, as indicated by flow arrows 91 in FIG. 3. Plenum 90 is defined in part by a housing 92 that also supports fans 52. In the example shown, two elongated heating elements 50 spanning the full width of print substrate 26 are mounted along the bottom of housing 92 and air is discharged from plenum 90 through an array of holes 94 in housing 92 immediately downstream from heating elements 50.

Vapor control heater 42 can provide the heat needed to prevent moisture condensing in the flow of air exiting the printer. If condensation is stopped in the air stream leaving the printer, it will then be more difficult for condensation to form as the air stream disperses into the area surrounding the printer. The power output of heater 42 may be varied by energizing one or both heating elements 50, for example to supply more heat for high density or high speed printing on vinyl and other less absorbent substrates and less heat for lower density or lower speed printing on more absorbent substrates. Alternatively, a single variable power heating element could be used to vary the heat level or a constant power heating element could be used when no variation in power level is desired. A temperature sensor 54 (FIG. 1) may be used to monitor the room temperature to help control heating element 50 and fans 52 in vapor control heater 42. For example, if the room temperature is high enough that there is little risk of condensation in the air stream leaving the printer, then heater 42 may be shutdown.

Other suitable vapor control heating configurations are possible. For example, individual heating elements corresponding to each fan could be used, the fans could be positioned downstream from the heating element(s) to draw air through the heating element(s) into the plenum, more or fewer fans could be used, and/or heated air could be ducted directly to the print zone without a plenum. However, unlike the lower flow print zone heater, the vapor control heater usually will utilize a much higher air flow to provide the desired mixing. Thus, it is expected that more and/or higher volume fans and heating element(s) spanning the width of the print substrate will be desirable for most printing environments compared to the print zone heater.

Figure 12:
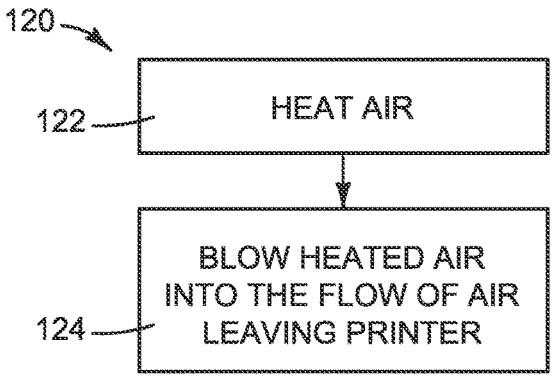
FIG. 12 is a flow diagram illustrating one example of a method for introducing heated air into the discharge air flow such as might be implemented with the vapor control heater shown in FIGS. 3, 10 and 11.

FIG. 12 is a flow diagram illustrating one example of a method 120 for introducing heated air into the discharge air flow such as might be implemented with vapor control heater 42 shown in FIGS. 3, 10 and 11. The method of FIG. 12 may be performed, for example, at the direction of controller 28 executing air heating instructions 34. Referring to FIG. 10, air is heated (step 122) and the heated air is blown into the flow of air leaving the printer (step 124).

Figure 13:
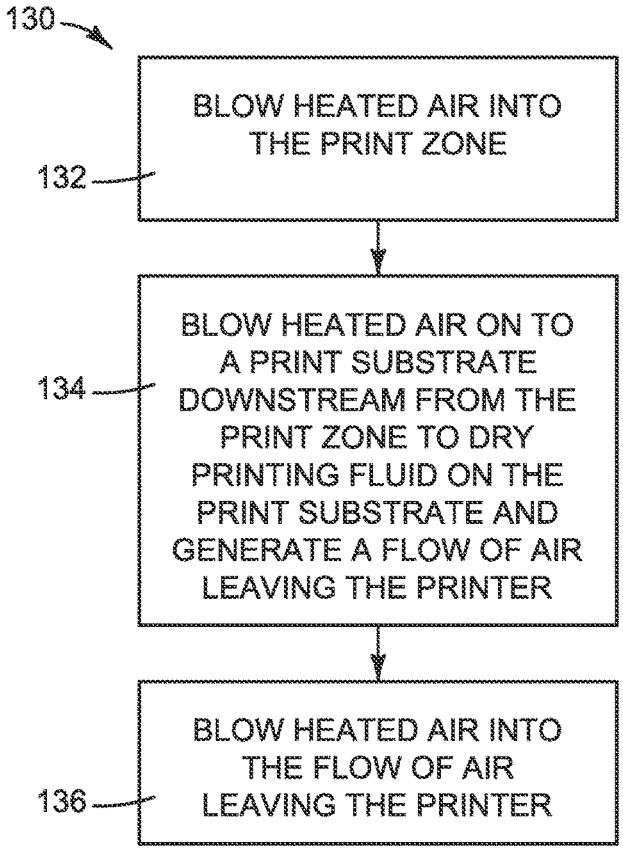
FIG. 13 is a flow diagram illustrating one example of a method for print zone heating and vapor control such as might be implemented with the heater in FIGS. 3-11.

FIG. 13 is a flow diagram illustrating one example of a method 130 for print zone heating and vapor control such as might be implemented with heater 38, dryer 40 and heater 42 in FIG. 3. The method of FIG. 13 may be performed, for example, at the direction of controller 28 executing air heating instructions 34. Referring to FIG. 13, heated air is blown into the print zone (step 132). Heated air is blown on to a print substrate downstream from the print zone to dry printing fluid on the print substrate, generating a flow of air leaving the printer (step 134). Heated air is blown into the flow of air leaving the printer (step 136).

It may not be desirable in all printing applications to utilize both a print zone heater 38 and a vapor control heater 42. For example, for printers without a hot air dryer or for lower production printers in which condensation is not likely to be a problem, a vapor control heater may be undesirable even in cooler operating environments in which a print zone heater is beneficial. For another example, a print zone heater may be unnecessary in operating environments regularly at or above the desired print zone temperature whether or not a vapor control heater is used to inhibit condensation. Thus, an air heating system for a printer, such as system 12 shown in FIG. 1 may include a print zone heater 38 or a vapor control heater 42, or both.

"A" and "an" used in the claims means one or more.

As noted at the beginning of this Description, the examples shown in the figures and described above illustrate but do not limit the disclosure. Other examples are possible. Therefore, the foregoing description should not be construed to limit the scope of the disclosure, which is defined in the following claims.

What is claimed is:

1. A print zone heater, comprising:

a structure defining a plenum to support a movable carriage to carry a printhead through the print zone, the plenum being a single plenum spanning the print zone;

a heating element;

a fan to move air over the heating element into the plenum; and a conduit from the plenum to carry heated air into the print zone and the conduit comprising multiple conduits spaced apart across the plenum to discharge multiple streams of heated air into the print zone, wherein the conduits are positioned upstream from the printhead along a path a print substrate moves through the print zone and oriented to discharge heated air downstream along the path.

2. The heater of claim 1, further comprising:

a controller; and a temperature sensor associated with the heating element;

the controller to control the heating element based on output from the temperature sensor.

3. The heater of claim 1, wherein the heating element comprises a plurality of heating elements and the fan comprises a plurality of fans, each arranged to blow air over a corresponding heating element, the heater further comprising a controller to independently operate the heating elements of the plurality of heating elements so as to vary the temperature of air output by the heater.

4. The heater of claim 1, wherein the plenum has a triangular cross section with the fan arranged to blow air into an open side of the plenum, the plenum tapering to a corner of the triangular cross section, opposite the open side, where the conduit connects into the plenum.

5. The heater of claim 1, wherein the heating element is a variable power heating element to supply more heat when the print zone is cooler and less heat when the print zone is warmer, the heater further comprising a temperature sensor to monitor a temperature of the print zone.

6. A method for heating a print zone in a printer, comprising blowing heated air into the print zone, wherein blowing heated air into the print zone comprises:

heating air to a first temperature and blowing the first temperature air into the print zone for a first time; and then heating air to a second temperature lower than the first temperature and blowing the second temperature air into the print zone for a second time longer than the first time.

7. The method of claim 6, wherein:

blowing heated air into the print zone comprises blowing heated air through a plenum and into the print zone; and the method further comprises supporting a printhead carriage with a structure defining the plenum simultaneously with blowing heated air through the plenum.

8. The method of claim 6, further comprising blowing heated air into a flow of air leaving the printer.

9. The method of claim 6, further comprising: blowing heated air on to a print substrate downstream from the print zone, generating a flow of air leaving the printer; and blowing heated air into a flow of air leaving the printer.

10. An air heating system for an inkjet printer having a print zone in which printing fluid may be dispensed on to a print substrate, the system comprising:

a print zone heater to blow heated air into the print zone, the print zone heater comprising a plurality of heating elements and a plurality of fans, each fan arranged to blow air over a corresponding heating element, the print zone heater further comprising a controller to independently operate the heating elements so as to vary the temperature of air output by the print zone heater;

a dryer to blow heated air on to the print substrate after printing fluid is dispensed on to the substrate in the print zone; and a vapor control heater to blow heated air into a flow of air from the dryer after the air flow passes over the print substrate.

11. The system of claim 10, wherein the print zone heater comprises:

a structure defining a plenum, the plurality of heating elements to move air into the plenum; and a conduit from the plenum to carry heated air into the print zone.

12. The system of claim 11, wherein the structure defining the plenum supports a movable carriage to carry a printhead through the print zone.

13. The system of claim 10, wherein the vapor control heater comprises:

a fan to move air over the heating element and into the flow of air from the dryer.

14. The system of claim 10, wherein the dryer is arranged to deliver hotter air at a higher flow rate as compared to the print zone heater.

15. The system of 10, wherein the vapor control heater is arranged to introduce warm air into moisture laden air as that moisture laden air is exiting the printer.

16. The system of claim 10, wherein the vapor control heater is shutdown during operation of the printer in response to a room temperature above a threshold.

* * * * *